United States Patent [19]

Ohshima et al.

[11] Patent Number: 4,607,958

[45] Date of Patent: Aug. 26, 1986

[54] APPARATUS FOR STIRRING HYDROGEL PARTICLES OF WATER-SOLUBLE POLYMER

[75] Inventors: Iwao Ohshima; Takeshi Narita, both of Yokohama; Ryoji Handa, Yokosuka; Jun Hosoda, Yokohama, all of Japan

[73] Assignee: Nitto Kagaku Kogyo Kabushiki Kaisha, Tokyo, Japan

[21] Appl. No.: 678,451

[22] Filed: Dec. 5, 1984

[30] Foreign Application Priority Data

Dec. 16, 1983 [JP] Japan ..... 58-237697

[51] Int. Cl.[4] ..... B01F 15/02; B01F 7/20

[52] U.S. Cl. ..... 366/192; 366/65; 366/194; 366/309; 366/314

[58] Field of Search ..... 366/65, 66, 67, 64, 366/309, 311, 312, 313, 279, 292, 293, 302, 306, 314, 325, 327, 329, 331, 144, 145, 192, 193, 194

[56] References Cited

U.S. PATENT DOCUMENTS

| | | | |
|---|---|---|---|
| 3,160,400 | 12/1964 | Harrison | 366/65 |
| 3,194,543 | 7/1965 | McIlvaine | 366/309 |
| 3,536,304 | 10/1970 | Fejmert | 366/65 |
| 3,560,454 | 2/1971 | Buning . | |
| 4,453,831 | 6/1984 | Mahon | 366/65 |
| 4,506,984 | 3/1985 | Strehlow | 366/67 |

FOREIGN PATENT DOCUMENTS

| | | |
|---|---|---|
| 395759 | 7/1933 | United Kingdom . |
| 919731 | 2/1963 | United Kingdom . |
| 977629 | 12/1964 | United Kingdom . |
| 1026460 | 4/1966 | United Kingdom . |
| 1042588 | 9/1966 | United Kingdom . |
| 1167940 | 10/1969 | United Kingdom . |
| 1289450 | 9/1972 | United Kingdom . |

*Primary Examiner*—Robert W. Jenkins

*Attorney, Agent, or Firm*—Robert E. Burns; Emmanuel J. Lobato; Bruce L. Adams

[57] ABSTRACT

Apparatus for stirring hydrogel particles of a water-soluble polymer made as a tank defined by a drum within which is housed an inner drum. Water-soluble polymers are introduced through a top opening in the tank into an annular space defined by the inner wall surfaces of the tank and the outer wall surfaces of the inner drum. The water-soluble polymer contents in the annular space are stirred by vanes mounted on a corresponding vertically disposed driven arms. The vanes have leading surfaces advanced in different circular paths within the annular space. One of the vane stirring arms and vane thereon is disposed to travel along a circular path in the vicinity of the inner surfaces of the tank and the other stirring arm vane and corresponding vane are advanced along a circular path in the vicinity of the outer wall surfaces of the inner drum. The leading surfaces of the vanes are disposed at an angle relative to a corresponding radial plane passing the annular space within which the water-soluble polymer contents are stirred. The vanes urge the contents inwardly of the space away from the inner wall surfaces of the tank and outer wall surfaces of the inner drum respectively. The leading surfaces can be disposed to effectively urge the contents being stirred upwardly away from the bottom by an upward component of the force applied upon advancement of the vanes.

12 Claims, 3 Drawing Figures

APPARATUS FOR STIRRING HYDROGEL PARTICLES OF WATER-SOLUBLE POLYMER

BACKGROUND OF THE INVENTION

The present invention relates to a novel method and apparatus for mixing and stirring a hydrogel of a water-soluble polymer with various chemicals while eliminating troubles caused by mutual adhesion of small particles of the hydrogel which are soluble in water and have a strong tendency to adhere to one another.

SUMMARY OF THE INVENTION

In accordance with the present invention, there is provided an apparatus for stirring or agitating hydrogel particles of a water-soluble polymer, which comprises (A) an annular stirring tank comprising a bottom portion, an outer circumferential portion consisting of an inner face of an outer cylindrical barrel having a substantially vertical axis and an inner circumferential portion consisting of an outer face of an inner cylindrical barrel which is coaxial with said outer cylindrical barrel and has a diameter smaller than that of said outer cylindrical barrel, (B) at least one stirring arm disposed substantially vertically to move along the vicinity of said outer circumferential portion and at least one stirring arm disposed substantially vertically to move along the vicinity of said inner circumferential portion, and (C) at least one stirring vane attached to each stirring arm and being inclined to the normal line of the moving direction of the stirring arm so that a material to be stirred is pressed in a direction away from the outer circumferential portion, inner circumferential portion or bottom portion of the annular stirring tank.

DETAILED DESCRIPTION OF THE INVENTION

Peculiarity of Stirring of Hydrogel Particles

Figure 1:
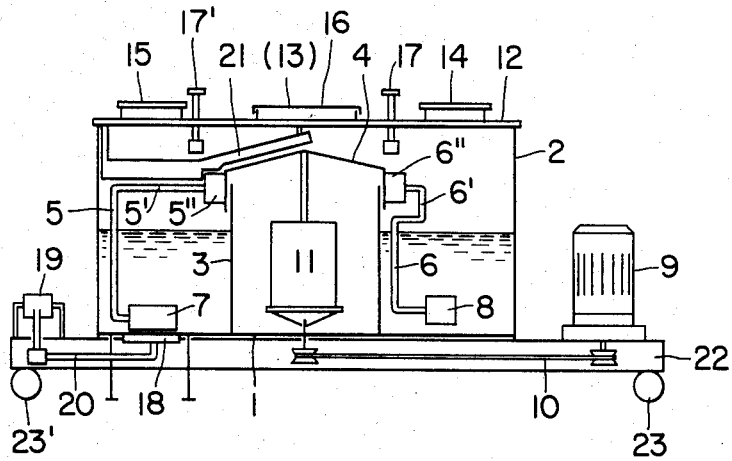
FIG. 1 is an elevation, partly in vertical section illustrating diagrammatically one embodiment of the apparatus according to the present invention.

The stirring apparatus of the present invention has the above described structure. A stirring apparatus having a similar structure has been practically used as a mortar mixer or a concrete mixer. One of the important differences of the apparatus of the present invention from this known mixing apparatus resides in that vertical stirring arms for supporting stirring vanes are arranged at points distant from inner and outer circumferential portions of an annular mixing tank in the known mixing apparatus. This difference is substantially significant when hydrogel particles are stirred. In the known mixing apparatus, stirring of this special material to be stirred is impossible.

In the case where main stirring is accomplished by stirring vanes rotating in the horizontal plane as in the apparatus of the present invention and the above-mentioned known mixing stirring apparatus, an important advantage over a so-called kneader, a ribbon screw mixer or a lateral rotary cylinder type mixer is attained. More specifically, the volume of the scraping-up space is small and the ratio of the volume of the material to be mixed per unit volume of the machine is increased. Accordingly, the above-mentioned mixing apparatus is advantageously used for a material which can be stirred by application of a small shearing force during the mixing operation, such as mortar or concrete.

However, in case of hydrogel particles of a water-soluble polymer such as hydrogel particles of an acrylamide-type polymer, which have a strong tendency to adhere to one another, in the above-mentioned known mixing apparatus having a structure similar to the structure of the apparatus of the present invention, gel particles begin to adhere to one another in a short time from the start of the mixing operation, and shortly after, several large masses are formed.

The present invention has been conceived and developed as a result of our research on occurrence of mutual adhesion of gel particles and growth of gel particles for utilizing advantages of the mixing apparatus of the known construction. It was found that mutual adhesion of small gel particles starts at the front part in the rotation direction of the vertical stirring arm and also at the leading edge in the advance direction of the stirring vane orientated perpendicularly to the advance direction. It was also found that with respect to mutual adhesion started at the latter-mentioned leading edge, if the stirring vane is inclined to the direction perpendicular to the advance direction, that is, if the stirring vane is arranged so that the small gel particles slip and escape to the right or left while the small gel particles are pressed by the stirring vane and the small gel particles are thus separated from the apparatus wall, occurrence of mutual adhesion of gel particles can be greatly retarded. In this case, the stirring vane is so arranged that one end of the stirring vane moves through a path in the very close vicinity (less than 20 to 30 mm) of the circumferential or bottom wall of the annular stirring tank.

However, even if the stirring vane is so arranged as to prevent occurrence of mutual adhesion of the small gel particles in the vicinity of the stirring vane as pointed out above, mutual adhesion of the small gel particles will occur in the vicinity of the vertical stirring arm for supporting the stirring vane while stirring of the small gel particles is continued, and agglomerates of particles adhering to one another will be wound round the portion close to the stirring arm and will further grow.

We have found that if a slight shearing force is applied to the small gel particles just when mutual adhesion thereof is about to start in the vicinity of the stirring arm, the progress of mutual adhesion of the small gel particles will be stopped. That is, if a slight shearing force is applied to the small gel particles just when mutual adhesion of small gel particles is about to start in the vicinity of the stirring arm, the small gel particles will be separated from the stirring arm while the mutual adhesion is still weak, and therefore growth of the small gel particles adhering to one another to form large agglomerates will be prevented.

Several methods may be considered for applying such a slight shearing force. For example, a method in which baffle plates for imparting a shearing force are disposed on slightly inner and outer sides of the path of the advance of the stirring arm may be considered. However, this method is found to be unsatisfactory in that good mixing cannot be expected, and it is impossible to continuously apply a shearing force.

In the present invention, the relative movement between the wall faces of the annular stirring tank and the stirring arm in the mixing apparatus is utilized for imparting a shearing force to the small gel particles which are present in the vicinity of the stirring arm and are about to adhere to one another. More specifically, it was found that by moving the stirring arm in the close vicinity of the wall faces of the annular stirring tank, a sufficiently large shearing force is imposed on the small gel particles, which are just beginning to be wound round the stirring arm between the wall face and the stirring arm, and growth of these small gel particles to form large agglomerates is prevented. In this structural configuration, if the gel particles adhere to the stirring arm, a shearing force will always and continuously be applied to the adhering gel. On the other hand, if there is no adhering gel, unnecessary shearing force will not be applied.

The distance between the stirring arm and the wall of the annular stirring tank is very small, but it is difficult to specify a specific value of this distance. However, this distance is ordinarily in the range of several millimeters to a value slightly larger than the thickness of the stirring arm (a number of tens of millimeters).

Stirring Apparatus of the Invention

The stirring apparatus comprises an annular stirring tank and stirring arms provided with stirring vanes having a specific structural configuration.

Figure 2:
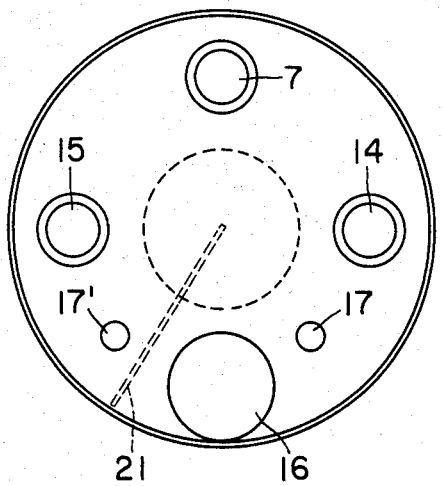
FIG. 2 is a plan view of a principal part of the apparatus shown in FIG. 1.
Figure 3:
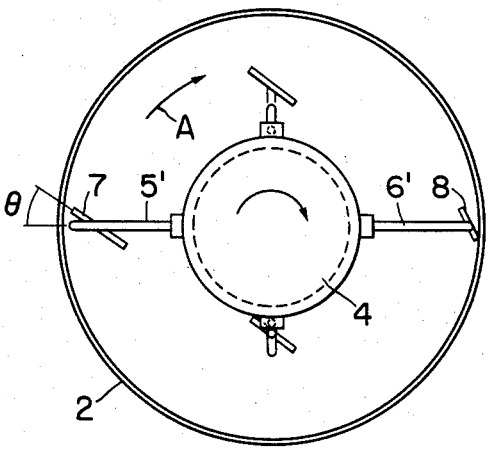
FIG. 3 is a plan view showing the interior of the apparatus shown in FIG. 1.

One embodiment of the stirring apparatus of the present invention will now be described with reference to the accompanying drawings. FIG. 1 is an elevation, partly in vertical section of this apparatus; FIG. 2 is a plan view of the stirring tank of the apparatus; and FIG. 3 is a plan view showing the interior of the stirring tank.

Referring to FIG. 1, the annular stirring tank comprises a bottom 1, an outer circumferential portion consisting of the inner face of an outer cylindrical barrel or drum 2 and an inner circumferential portion consisting of the outer face of an inner cylindrical barrel 3 disposed coaxially within the outer cylindrical barrel or drum 2. The dimensions of the stirring tank for treating 20 Kg of an aqueous gel of polyacrylamide (water content=70%) are such that the diameter of the outer cylindrical barrel 2 is about 0.9 m, and the diameter of the inner cylindrical barrel 3 is about 0.2 m. An inner cylinder cover 4 is revolvably fitted on the upper open end of the barrel 3. Stirring arms 5 and 6 are attached to the cover 4 through intermediate arms 5' and 6', respectively. The arms 5 and 6 are orientated substantially vertically, and the arms 5 and 6 are disposed so that they are moved along the outer and inner circumferential portions of the annular stirring tank, respectively. At least one arm 5 and at least one arm 6 are provided. It is preferable that the distance of the arm 5 or 6 from the outer or inner circumferential portion of the annular stirring tank, along which the stirring arm 5 or 6 moves, be relatively small. More specifically, it is preferred that this distance be less than two times the diameter of the stirring arm.

The stirring arm is ordinarily formed from a round rod (having a diameter of, for example, 20 to 50 mm). In the case where the stirring arm has another sectional shape, the width of the silhouette of the arm projected in the advance direction of the arm is regarded as the diameter of the stirring arm.

Each of the stirring arms 5 and 6 has at its working end at least one stirring vane 7 or 8 which is inclined to the normal line of the moving direction of the stirring arm. By the expression "the stirring vane is inclined to the normal line of the moving direction of the stirring arm" is meant that the pressing force from the material to be stirred, that is, the polymer gel (containing chemicals), does not act perpendicularly on the face of the stirring vane during the stirring operation. More specifically, as shown in the plan view of FIG. 3 (described in detail hereinafter), the stirring vane is fixed to the stirring arm so that the partial pressure in the radial direction of the annular stirring tank acts on the material to be stirred or this partial pressure acts in the axial direction, that is, the vertical direction, of the annular stirring tank. In order to produce this partial pressure, for example, a method in which, as shown in FIG. 3, the stirring vane is attached to the stirring arm 5 (since the stirring arm 5 is located in the vertical direction, it is not seen in FIG. 3) at an angle $\theta$ may be adopted. In this case, it is preferred that the angle $\theta$ be about 30° to about 70° (the same holding true also in the case where the stirring vane is attached so that the partial pressure acts in the axial direction).

The partial pressure applied to the material to be stirred by slanting attachment of the stirring vane is selected so that the material to be stirred is pressed to the central part of the stirring tank, that is, from the outer circumferential portion to the inner circumferential portion and from the inner circumferential portion to the outer circumferential portion in the stirring tank shown in FIG. 3. In the tank shown in FIG. 3, this requirement is satisfied if the moving direction of the stirring vane is as indicated by arrow A. In the case where the stirring vane is so attached that a partial pressure acting in the upward direction is produced, it is preferable that the stirring plane arranged in the vicinity of the bottom portion be inclined so that the material to be stirred is pressed upward.

It is preferable that the area of the stirring vane be about 1 to about 20% of the area occupied by the material to be stirred in the portion of the annular stirring tank where the stirring vane is present. It also is preferred that the attachment position of the stirring vane be selected so that the loci of the respective stirring vanes passing through the material to be stirred during the stirring operation do not overlap one another, and the distances between the end of the stirring vane and the circumferential wall and bottom of the mixing tank be less than 20 to 30 mm.

Optional means can be adopted for driving the stirring arms. For example, rotary power can be transmitted from a speed-variable motor 9 disposed outside the outer cylinder 2 through a belt 10 to the inner cylinder cover 4 through a speed reduction mechanism 11 installed within the inner cylinder 3.

The stirring apparatus of the present invention is ordinarily used in a state where various accessory devices are attached thereto. For example, the annular stirring tank ordinarily has a lid 12. A gel particle charging opening 13, a cooling air supply opening 14, an exhaust opening 15, an interior checking window 16 (ordinarily lidded) and heating steam inlets 17 and 17' (nozzles are formed on the top ends) are provided on the lid 12. A discharge opening for discharging gel particles after the mixing operation is provided in the bottom 1. This discharge opening is covered with a lid 18 during the stirring operation but, at the time of the discharging operation, the lid 18 is removed through a link 20 by a pneumatic or electric driving device 19.

Since the material to be stirred is charged from the upper portion of the apparatus, a portion of the material to be stirred is sometimes accumulated on the lid 4, the horizontal part 5' of the stirring arm and stirring arm-attaching seats 5'' and 6''. Accordingly, a scraper 21 can be installed, for example, on the lower face of the lid 12 so as to scrape down the accumulated material. In order to weigh the material to be stirred, the entire mixing apparatus may be placed on a stand 22 which is placed on weight-measuring machines 23 and 23'.

Although the stirring apparatus of the present invention may be constructed by using appropriate materials, it is preferable that the parts to contact the hydrogel particles be fabricated from a stainless steel or a chromium-plated metal.

Gel

It is necessary that certain chemicals be added to and admixed with the hydrogel cf the water-soluble polymer to be treated in the apparatus of the present invention. For example, hydrogels of water-soluble polymers such as polyacrylamide, anion- or cation-modified polyacrylamide, an acrylamide type copolymer comprising a major amount of acrylamide, polyacrylic acid (or its salt), polyvinyl alcohol and carboxymethyl cellulose are treated. Even an acrylamide type polymer having an especially high tackiness among these polymers can be effectively treated by the apparatus of the present invention.

The hydrogel to be stirred by the apparatus of the present invention has substantially no flowability, and even when it is taken out from a vessel and is allowed to stand still, the shape of the gel is changed only slightly by the elasticity and some plasticity of the gel per se. These properties differ according to the composition and molecular weight of the polymer and the water content of the gel. Although it is difficult to strictly specify the molecular weight and water content, in the case of an acrylamide type polymer, the molecular weight is about 3,000,000 to about 20,000,000, and the water content is about 50 to about 85%.

Disintegration of Gel

Before admixture of various chemicals into the hydrogel of the water-soluble polymer, the gel is disintegrated into small particles having an average particle size of about 3 to about 20 mm, preferably about 5 to about 10 mm. For this disintegration, the pulverizing mechanism previously proposed by us is suitably used (as disclosed in Japanese Patent Publication No. 32176/79 and Specification of U.S. Pat. No. 3,905,122).

The shape of the small gel particles is not particularly restricted. Spherical, cubic, prismatic or irregularly shaped pulverized particles can be used, so long as they are small particles having an average particle size as mentioned above. However, excessively long particles, for example, particles having a noodle-like shape, are not preferred. The particle size distribution is not particularly critical. If the diameter in the case of spherical particles (spherical particles cannot be formed by disintegration and pulverization) or the length of the shorter side in the case of cubic or prismatic particles exceeds about 10 mm, the speed of diffusion and penetration of added chemicals into the gel particles is reduced, and the distribution of the chemicals in the gel particles becomes uneven, with the result that undesirable influences are sometimes imparted to the properties of the obtained polymer.

If the particle size of small gel particles is reduced, the concentration distribution of chemicals in the small gel particles can be narrowed. However, in order to disintegrate the gel into very small particles, a larger shearing force is ordinarily necessary, and if such a large shearing force is applied, undesirable reduction of the molecular weight of the polymer is caused. In view of the foregoing, the average particle size of the small gel particles is adjusted to 3 to 20 mm, preferably 5 to 10 mm.

Additive Chemicals

Examples of the chemicals to be added to small gel particles in the present invention are a polymer modifier to be used for anionic or cationic modification of polyacrylamide and a stabilizer for preventing formation of water-insoluble substances or preventing reduction of the viscosity of an aqueous solution of the polymer at the step of heating and drying the gel.

The additive chemicals can be admixed into the gel in the form of a powder, an aqueous solution or a slurry.

Stirring Conditions

We have found that, when additive chemicals are scattered in the form of an aqueous solution on small gel particles just after scattering, that is, during the period before the aqueous solution is absorbed to some extent into the small gel particles, the tendency of the small gel particles to adhere to one another is extremely weak, and the aqueous solution acts as a lubricant for the movement of the small gel particles for a very short time. Of course, the length of this very short time differs according to the composition of the gel, the properties of the aqueous solution and the amount of the aqueous solution added to the gel, but ordinarily, this short time is in the range of from about 10 seconds to 2 or 3 minutes. When this time has elapsed, the tendency of the particles to adhere to one another is drastically increased. It is considered that the reason for this is that the water content in the surfaces of the small gel particles becomes higher than the water content before the addition of the aqueous solution of the chemicals to enhance the mutually adhering property.

It is preferred that the mixing conditions in the apparatus of the present invention be decided so that uniform mixing is completed while the mutually adhering property of small gel particles is reduced as pointed out above. More specifically, the stirring time is in the range of 10 seconds to 10 minutes, preferably 30 seconds to 5 minutes. Needless to say, not only the mixing time but also the rotational speed of the stirring shaft for attaining uniform mixing is important. Furthermore, the number and shape of the stirring vanes of the stirring apparatus are important factors. The rotational speed of the stirring shaft is 10 to 100 rpm, preferably 20 to 60 rpm. In order to obtain a uniform mixing (stirring) effect, it is preferable that the number of the rotation of the stirring shaft be at least 90 in the case of three vanes or at least 60 in the case of five vanes.

It is preferable that the stirring time and the rotational speed of the stirring shaft be such that the value of [shaft rotational speed (rpm)×mixing time (minutes)×number of vanes] will be at least 200, especially at least 250. The shaft rotational speed, mixing time and number of vanes are selected according to the ordinary designing procedure with consideration of the mechanical strength and mixing power for the shaft rotation speed, the change of the mutually adhering property of small gel particles for the mixing time and the apparatus layout for the number of vanes.

In this connection, in the case where the reaction is carried out after addition of the chemicals to the small gel particles, it is necessary to adjust the temperature of the small gel particles to a specific level.

The temperature adjustment is accomplished by either heating or cooling. Either of these modes of adjustment can be easily performed in the present invention.

(A) Heating

A method in which steam is blown into the stirring apparatus during the mixing operation is most preferred. Any of superheated steam, saturated steam and wet steam may be used as the steam. The greater part of the blown steam is condensed on the surfaces of small gel particles, and by this condensation heat, the small gel particles are heated. The condensed water acts as a lubricant for the small gel particles during the mixing operation.

(B) Cooling

The temperature of high-temperature small gel particles can be lowered by the heat of evaporation of the particles by utilizing the ambient atmospheric air (outer air) during the mixing operation. More specifically, in the apparatus shown in the accompanying drawings, the outer air is taken in from the air supply opening 14 and the air is discharged from the outlet 15 by natural or enforced convection, whereby the small gel particles can be easily cooled. In this case, however, since water is lost from the surfaces of the small gel particles, undesirable promotion of mutual adhesion of the small gel particles is sometimes caused. Accordingly, it is necessary to control the evaporation of water while taking into consideration the amount added of the aqueous solution of the chemicals.

The present invention will now be described in detail with reference to the following examples of experiments that by no means limit the scope of the invention.

Referential Example (A) Polymerization

An acrylamide aqueous solution having the following composition was charged into a polymerization tank having a capacity of 200 liters.

Acrylamide: 39.0 Kg

Sodium stearate: 0.006 Kg

Deionized water: 110 Kg

The temperature was adjusted to 10° C. while dissolved oxygen was amply expelled with nitrogen gas. As the polymerization initiator, the following chemicals, separately dissolved in water, were added for every 0.3 liter of deionized water, and nitrogen gas was blown into the tank under stirring for about 10 minutes.

Dimethylaminopropionitrile: 67.5 g

Potassium persulfate: 45 g

When about 15 minutes had passed from the instant of stopping of blowing of nitrogen gas and stirring, polymerization was started. Then, after about 100 minutes, the speed of elevation of the temperature was reduced, and the polymerization was completed. The temperature at this time was about 90° C.

(B) Disintegration of Gel

A disintegrating machine (large meat grinder) in which a plate having many holes of a diameter of 7 mm was attached to the end portion of a cylinder provided therewithin with a screw and a knife having 4 blades and disposed immediately before the plate was caused to rotate simultaneously with the screw was used for disintegrating the gel masses obtained as described above. The size of the formed small gel particles was about 2 to about 10 mm. Although the hole diameter of the plate was 7 mm, since some particles passed through the holes while undergoing elastic deformation, certain particles of sizes larger than the hole diameter were passed. The temperature of the obtained small gel particles was in the range of from about 70° C. to about 85° C.

EXAMPLE 1

A stirring apparatus having a construction as shown in the accompanying drawings was used. The inner diameter of the cylindrical portion 2 was 0.9 m, the depth was 0.35 m, and the outer diameter of the cylindrical portion 3 was 0.2 m. Three vertical stirring arms were so arranged that two of them passed through the very close vicinity of the inner side of the cylinder 2, and the other stirring arm passed through the very close vicinity of the outer side of the cylinder 3. The portion of the stirring apparatus to come into contact with the small gel particles was formed from stainless steel.

Into this stirring apparatus was charged 61 Kg of the above described small gel particles, and the surface of the charge was levelled. Separately, about 2 liters of a red ink diluted to some extent with water was used for observing the mixing state. In the state wherein stirring was stopped, the diluted red ink was uniformly sprinkled on the small gel particles, and immediately, the stirring shaft was rotated at a speed of 21 rpm. Every time the mixing was conducted for 10 seconds, 20 seconds, 30 seconds, 45 seconds, 1 minute, 2 minutes, 3 minutes and 4 minutes, stirring was stopped, and the mixing state was observed by photographing and sampling.

When the mixing operation was conducted for 1 minute, the small gel particles were macroscopically uniformly mixed. When a sample collected after 3 minutes' mixing was microscopically observed, it was found that the mixing state was still insufficient. However, when the mixing operation was conducted for 4 minutes, a good mixing state was obtained.

EXAMPLE 2

The same stirring apparatus as used in Example 1 was used. The amount of the small gel particles charged was 62 Kg. The red ink was added by using a spray nozzle.

The stirring shaft was rotated at 41 rpm. After about 1 minute, about 2 liters of the red ink was added from the spray nozzle over a period of about 30 seconds. The mixing operation was conducted for 7 minutes from the instant of starting of the addition of the red ink. The gel was photographed during the mixing operation while stirring was continued. The discharge opening at the bottom of the stirring apparatus was slightly opened, and the colored gel was taken out and observed in detail. When the mixing operation was conducted for 2 or 3 minutes, the mixing state was amply good even microscopically. It was found that when the mixing operation was conducted for 7 minutes, the small gel particles were pulverized, and the average particle size was reduced.

EXAMPLE 3

A stirring apparatus having a construction as shown in the drawings was used. The inner diameter of the cylindrical portion 2 was 1.36 m, the depth was 0.72 m, and the outer diameter of the cylindrical portion 3 was 0.50 m. Five stirring arms were so arranged that the distance between three of these arms and the inner wall surface of the cylindrical portion 2 was 20 to 50 mm, and the distance between the remaining two stirring arms and the outer wall surface of the cylindrical portion 3 was 20 to 50 mm. The thickness of each stirring arm was 38 mm. Parts of the stirring apparatus to come into contact with the small gel particles were made of stainless steel 304, the surface of which was polished by buffing with buff #300.

The stirring apparatus was charged with 200 Kg of the small gel particles, and the stirring shaft was rotated at 23 rpm. Simultaneously, 9.8 Kg of a 30% aqueous solution of caustic soda was added through a spray nozzle over a period of about 20 seconds. Stirring was conducted for a total time of 3 minutes. Every time stirring was conducted for 60, 90, 120, 150 and 180 seconds, the discharge opening at the bottom of the vessel was slightly opened, and about 1 Kg of the small gel particles being mixed with the aqueous alkali solution was sampled. The sampled small gel particles were placed in a polyethylene bag, aged at 70° C. for 9 hours, dried for 16 hours in a hot air drier maintained at 60° C., and pulverized. Particles having a size of 18 to 100 mesh were collected, and the physical properties of the polymer were determined. The temperature of the small gel particles was 68° to 72° C. when the alkali solution was admixed with the small gel particles.

The results obtained are shown in Table 1.

TABLE 1

| Stirring Time (seconds) | Viscosity (cps) of 1% Aqueous Solution | Hydrolysis Rate (%) | Solubility (%) |
|---|---|---|---|
| 60 | 11,540 | 15.0 | 1.2 |
| 90 | 12,400 | 17.0 | 0.6 |
| 120 | 12,840 | 19.3 | 0.6 |
| 150 | 12,600 | 19.3 | 0.2 |

The viscosity of the 1% aqueous solution was measured by means of a Brookfield viscometer of the BM type by using rotor No. 3 rotated at 6 rpm. The hydrolysis rate was the molar ratio of the hydrolyzed amide groups in polyacrylamide. The solubility was the amount of the polymer not dissolved when 0.5 g of the powdery polymer was added to 500 ml of deionized water in a beaker having a capacity of 500 ml, and the mixture was stirred for 2 hours.

From the foregoing results, it is seen that the mixing time of two minutes, inclusive of the time required for spraying the alkali solution, was satisfactory.

EXAMPLE 4

The same stirring apparatus as used in Example 3 was charged with 200 Kg of small gel particles the temperature of which was lowered (45° C.). The stirring shaft was rotated at 23 rpm and an alkali was added by using a spray. After completion of the addition of the alkali, saturated steam (slightly wet) under a gauge pressure of 7 $Kg/cm^2$ was introduced for about 90 seconds through a fan-shaped nozzle having opening diameters of 5 mm and 17 mm. The temperature of the small gel particles which had undergone stirring was about 75° C. Some small gel particles were caused to rise by the blowing action of the steam and were accumulated on the cylinder lid 4 and other parts. Otherwise, no particular changes were observed.

COMPARATIVE EXAMPLE 1

A mixing experiment was carried out by using the stirring apparatus of Example 3 in which one stirring arm positioned in the vicinity of the cylindrical portion 2 was shifted from the outside of the cylindrical portion 3 to the point where the distance to the inner wall surface of the cylindrical portion 2 was about 150 mm (substantially at the center of the annular stirring tank). Other operational procedures were the same as in Example 3.

When about 1 minute had passed from the instant of charging of the small gel particles and starting of stirring (23 rpm) (about 40 seconds had passed from the instant of addition of the aqueous alkali solution), agglomerates of the small gel particles adhering to one another began to wind round the stirring arms. When stirring was further continued, agglomerates of the small gel particles adhering to one another grew. When about 2 minutes passed, stirring had to be interrupted because no good mixing state could be expected, and industrial mixing became difficult because of abnormal increase of the power required for stirring.

What is claimed is:

1. Apparatus for stirring hydrogen particles of a water-soluble polymer comprising a stirring tank configured as a drum having a top provided with an opening for introducing into the tank the water-soluble polymer the hydrogel particles of which are to be stirred, an inner drum in the stirring tank coaxial therewith and of a lesser diameter and of a shorter height so that it fits entirely within the stirring tank and defines an annular space between the inner wall surfaces of the stirring tank and outer wall surfaces of the inner drum, said space containing in use hydrogel particles of a water-soluble polymer introduced through said top opening to be stirred in said space, stirring means for stirring the hydrogel particles of the soluble-water polymer contents in said space comprising vertically disposed driven stirring arms each mounting a respective vane thereon for advancement by the corresponding stirring arm along a circular path in said space, one of the stirring arms being disposed vertically to travel along a circular path in the vicinity of inner wall surfaces of the tank, another of the stirring arms being disposed to travel along a circular path in the vicinity of outer wall surfaces of the inner drum, the distance between said one stirring arm and said inner wall surfaces of said tank being less than twice the diameter of said one stirring arm, the distance between said another stirring arm and said outer wall surfaces of the inner drum being less than twice the diameter of said another stirring arm, each vane having a leading surface disposed substantially at an angle to a circular path at which it is advanced so that the hydrogel particles of the water-soluble polymer contents being stirred are urged in a direction inwardly of said space away from the inner wall surfaces of the tank by one vane and said hydrogel particles are urged in a direction inwardly of said space away from the outer wall surfaces of the inner drum by another vane, said tank having a bottom, and both vanes being disposed in the vicinity of said bottom so that said contents are urged away from said bottom during advancement of each of the vanes along a corresponding circular path.

2. Apparatus according to claim 1, in which said tank bottom has a bottom opening normally closed during said stirring, and means for opening said bottom opening for removing the stirred water-soluble polymer contents of said space.

3. Apparatus according to claim 1, including means for controlling the temperature of said water-soluble polymer contents in said space during stirring thereof.

4. Apparatus acording to claim 1, in which said leading surface of each said vane is disposed at an angle of about 30° to 70° between the leading surface and a plane passing through a radius of said annular space.

5. Apparatus according to claim 1, in which the leading surface of each vane is disposed to urge said contents with a component of force applied effective to urge said contents upwardly away from said bottom as each vane is advanced.

6. Apparatus according to claim 1, in which the area of each said leading surface is about 1% to about 20% of an area of said contents on a radial plane passing through said contents in said annular space.

7. Apparatus according to claim 1, in which said tank, said inner drum, said arms, and said vanes are made of stainless steel or a chromium-plated metal.

8. Apparatus according to claim 1, in which the two vanes are disposed at separate and different axial levels relative to the bottom of said tank.

9. Apparatus according to claim 1, in which said inner drum has a cover, a driven scraper for scraping said water-soluble polymer contents off of said cover.

10. Apparatus according to claim 1, including drive means comprising a motor externally of said tank for driving said two arms, and means connecting said motor and said arms including means disposed in said inner drum driven rotationally to which said two arms are connected.

11. Apparatus according to claim 1, in which each said distance between said one stirring arm and said another stirring arm and respective inner wall surfaces and outer wall surfaces in the vicinity of which the respective stirring arm is travels less than 100 mm.

12. Apparatus according to claim 1, in which the distances between an end of each said stirring vane and the respective wall surfaces and bottom of the stirring tank in the vicinity of which the stirring vane moves is less than 30 mm.

* * * * *

UNITED STATES PATENT OFFICE
CERTIFICATE OF CORRECTION

PATENT NO. : 4,607,958

DATED : August 26, 1986

INVENTOR(S) : Oshima et al

It is certified that error appears in the above-identified patent and that said Letters Patent are hereby corrected as shown below:

In the heading of the issued patent insert

--[73] Assignee: NITTO KAGAKU KOGYO KABUSHIKI KAISHA and MITSUBISHI RAYON COMPANY LIMITED--

Signed and Sealed this

Second Day of August, 1988

*Attest:*

*Attesting Officer*

DONALD J. QUIGG

*Commissioner of Patents and Trademarks*